United States Patent [19]

Boyer et al.

[11] Patent Number: 4,927,154

[45] Date of Patent: May 22, 1990

[54] GOLF PRACTICE DEVICE

[76] Inventors: Ralph C. Boyer, 1507 Missouri Ave., Crystal City, Mo. 63019; Edward C. Macauley, 1455 Reauville, St. Louis, Mo. 63122

[21] Appl. No.: 380,603

[22] Filed: Jul. 17, 1989

[51] Int. Cl.[5] ..... A63B 69/36

[52] U.S. Cl. ..... 273/200 R; 273/DIG. 21

[58] Field of Search ..... 273/200 R, 200 A, 200 B, 273/184 B, 185 C, 185 D, 196, 197 R, 197 A, 198, DIG. 21

[56] References Cited

U.S. PATENT DOCUMENTS

| | | | |
|---|---|---|---|
| 883,058 | 3/1908 | Sprague | 273/200 R |
| 1,326,976 | 1/1920 | Schnurr | 273/200 R |
| 3,122,369 | 2/1964 | Windall | 273/185 C |
| 3,502,337 | 3/1970 | Butkus | 273/200 R |
| 3,521,887 | 7/1970 | Butkus | 273/200 R |
| 3,826,439 | 7/1974 | Moon | 273/200 R |
| 4,071,250 | 1/1978 | Vroome | 273/200 R |
| 4,095,798 | 6/1978 | Marple | 273/200 R |
| 4,139,197 | 2/1979 | Windall | 273/DIG. 21 |

*Primary Examiner*—George J. Marlo
*Attorney, Agent, or Firm*—Kalish & Gilster

[57] ABSTRACT

A device for the practice of golf strokes by an individual alone or with a partner comprises a golf ball attached by a non-elastic tether cord to a cord reel, and an elastic segment attaching the tether cord to a device anchor post for facilitating ball return. The tether cord may be set to a preselected length as desired by the golfer and wound within the reel for storage after use.

6 Claims, 2 Drawing Sheets

GOLF PRACTICE DEVICE

BACKGROUND OF THE INVENTION

1. Field of the Invention

This invention relates, generally, to the game of golf and, more particularly, to a device which embodies unique ball retrieval means whereby an individual may practice various golf shots alone.

2. Description of the Prior Art:

Heretofore, apparatuses have been developed to permit a golfer to practice golf shots, primarily simulative of tee and fairway shots, without spending inordinate amounts of time in retrieving the ball. The Sprague Patent No. 883,058, which was issued in 1908, disclosed an anchor pin and ring assembly wherein the captured golf ball is engaged directly to a length of elastic cord-like material and, upon stroking, is thereby attached to travel rotatingly about an anchor pin, thus moving through a substantially circular path of limited radius. Some 70 years later, an alternative form of tethering a golf ball was shown in Marple Patent No. 4,095,798 wherein the tethered ball is attached directly to a non-elastic cord, providing for relatively increased flight. Schnurr Patent No. 1,326,976, Windall Patent No. 3,122,369 and Butkus Patent Nos. 3,502,337 and 3,521,887 all reveal elongated tethering members composed in part of nonstretchable and elastic components; none revealing facile retrievable means. The Wendall patent and that of Vroome Patent No. 4,071,250 provide for metal components, such a device having chain-forming elements providing a substantial portion of the tether itself. Such metal components are susceptible to rust or corrosion from ground dampness or from moisture in the air, as well as adding to the bulk and weight of the apparatus, which may inhibit flight of the golf ball during practice, as well as making storage and transport of the device more difficult.

None of the above patents disclose in addition to a compact, manually controlled reel for retaining the tether cord, an elastic segment to facilitate the return of the ball thereby obviating the need for the individual to have to move about a great deal between shots to regain the ball for positioning for the succeeding shot. Moon Patent No. 3,826,439, however, reveals a complex reel structure located within a relatively enlarged and apparently heavy housing having motor means for reel operation.

SUMMARY OF THE INVENTION

Therefore, it is an object of the present invention to provide a golf practice device for utilization by either two people simultaneously or an individual, unassisted and with means for effecting golf ball return without a great deal of travel by the golfer.

It is a further object of the present invention to provide a golf practice device of the type stated wherein there is included a manually operable tether cord storage structure.

It is another object of the present invention to provide a golf practice device of the type stated having unique means for checking the flight of the ball without integration into the ball tethering cord of non-elastic material.

It is a further object of the present invention to provide a golf practice device of the type stated which is constituted of a limited number of durable components for promoting long usage without diminution in operability.

It is a still further object of the present invention to provide a golf practice device of the type stated which is of exceedingly simple construction rendering the device lightweight and compact for easy portability and storage; the components thereof being resistant to corrosion, rust and breakage.

It is another object of the present invention to provide a golf practice device of the type stated which permits preselection of the distance of the flight of the ball.

It is a still further object of the present invention to provide a golf practice device of the type stated which permits preselection of anchoring the tether cord storage reel or maintaining the reel spacedly from the anchoring member.

It is a still further object of the present invention to provide a golf practice device of the type stated which may be more economically produced, while providing infinite durability of most portions of the same in usage, yet permitting simple replacement of the attached ball when necessary.

It is yet another object of the present invention to provide a golf practice device of the type stated which permits striking and flight of the golf ball as if it were unattached, thus providing a realistic assessment of the golfer's performance.

Other objects and features of the present invention will be, in part apparent and, in part, discussed hereinbelow. Briefly, in furtherance of the above, the present invention constitutes a device for the practice of golf strokes by either an unassisted individual or by more than one person simultaneously, with means for effecting ball return without substantial travel by the golfer. This device comprises a tethered cord of predetermined length being of a non-elastic character and extending between the golf ball and a reel comprised of a spool containing casing. An elastic segment of limited length extends between an anchoring member and a preselected point on the non-elastic cord. Provided on the tether cord is an integral component defined by its attachment at one end to the reel and at the other end by the point of attachment of the elastic segment for defining the maximum length of the trajectory of the golf ball and for checking the ball's flight. The elastic segment serves to prevent shock transfer to the reel when the captured golf ball reaches the end of its permitted flight and to facilitate return of the ball toward the golfer. The reel, which is light weight, provides means, easily manually operable, for winding up and storing the tether cord when play is finished.

DESCRIPTION OF PRACTICAL EMBODIMENTS OF THE INVENTION

Figure 3:
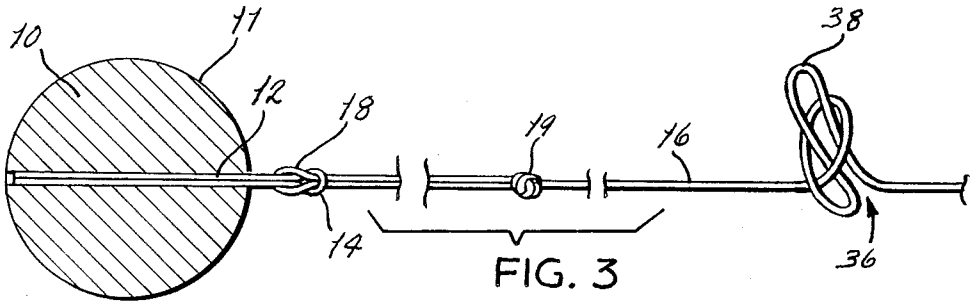
FIG. 3 is a fragmentary top plan view, in partial section, of the device illustrating the double strand of the non-elastic cord and the initial step in forming the knot for interconnecting the cord with the elastic segment.
Figure 6:
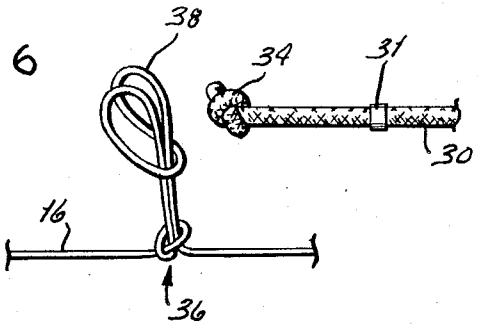
FIG. 6 is an exploded view of the knotted end portion of the elastic segment.
Figure 5:
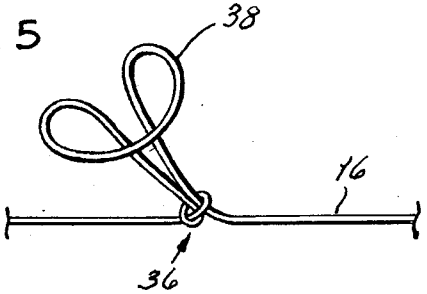
FIG. 5 illustrates the next succeeding step in the knot formation to that shown in FIG. 4.

Referring now by reference characters to the drawings which illustrate practical embodiments of the present invention, A designates a golf practice device comprising a golf ball 10 engaged by a double strand 12 of non-elastic elongated material, such as braided nylon cord; the end portions of double strand 12 are forced into and sealed, or otherwise fixed, within ball 10 and a loop 14 protrudes a short distance, as in the order of approximately one-half inch, from the exterior surface 11 of ball 10. A cord 16 of non-elastic elongated material, such as braided nylon cord, is folded over at one end forming a loop 18. Knot 19 is then formed with and secures the tip of cord 16. The limited length of cord 16 between knot 19 and loop 18 permits ball 10 to be slipped there through for removable attachment to cord 16, as shown in FIG. 3. Cord 16 is a preselected length with the opposite end thereof being firmly secured to a reel 20 (see FIG. 7) which is housed within a casing 22. Said casing is of relatively small, compact character and comprises a pair of nylon interengaged housing compartments *22a, 22b* for providing, when joined, a chamber c for accepting reel 20. Reel 20 is disposed upon a spool integral with a frusto-conical head projecting upwardly of the upper surface of housing member *22a*, as at e and having the usual crank arm (not shown). A suit able reel and spool structure is shown in U.S. Pat. No. 3,888,010 and the broad teachings thereto are included herein by reference.

Figure 7:
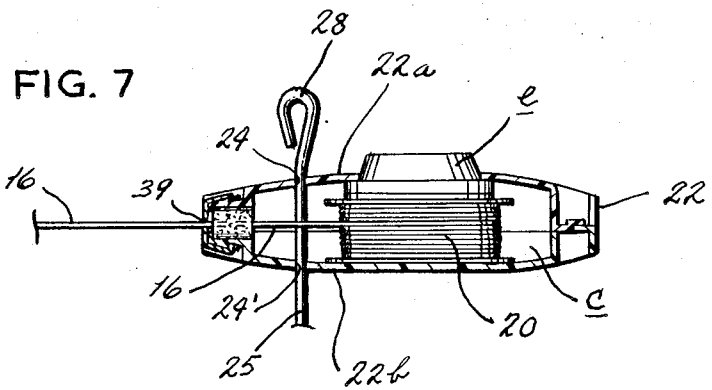
FIG. 7 is a side view of the reel casing, being in partial section.

As shown in FIG. 7 casing 22 may be provided with a pair of aligned appertures, 24, 24' respectively located in housing members *22a, 22b* for permitting extension through of an anchor post or tethering rod 25; the lower end thereof projecting beneath housing member *22b* for extension into the ground for preventing undesired displacement of reel casing 22. The upper end of pin 25, located spacedly above the upper surface of housing member *22a* is configured to provide a loop or eyelet 28 for purposes presently appearing.

Engaged to loop 28 of pin 25 is a cooperating loop 32 formed at one end of an elastic segment 30 of limited length; the same being provided by a double strand of elastic or stretchable material, such as particularly, rubber. The double strands of segment 30 are held together by means of bands or clips (probably of metal) as shown at 31. The end portions of elastic segment 30 are provided with knots 34 which are interconnected by a loop 38 to the cooperating knot 36 formed in non-elastic cord 16. It is to be observed that elastic segment 30 is of but limited extent.

By reference to FIGS. 3, 4, 5 and 6 the successive steps in the formation of knot 36 are revealed and such thus demonstrates a conventional slip-knot which is integral with non-elastic cord 16.

From the foregoing it will thus be observed that non-elastic segment 16 connects golf ball 10 with reel casing 22 by means of extension through an aperture 39 formed at one end of said casing 22 through which cord 16 extends for winding upon a spool 20.

In usage of device A, a player initially locates anchor post 25 in the approximate center of the practice area, preferably the extent of such area should be equal to or greater than twice the length of the extended non-elastic cord 16. Therefore pin 25 will cause casing 22 to be in travel-inhibitive position with the now extended non-elastic cord 16 and ball 10 may be optionally disposed upon a conventional golf tee, designated T, or, if desired, may be placed directly upon the ground for the practice of fairway shots. The ground as designated G should decidedly have short grass to prevent any inadvertent tangling of the cord 16. The player will attempt to address ball 10 so that the involved stroke will drive the ball in a direction toward anchor pin 25. When the ball has traveled a distance permitted by the length of cord 16, its flight will be checked by elastic segment 30 which will then be in a fully taut, expanded state and thereupon through the inherent resiliency thereof will provide a return force for cord 16 thereby tending to return same over anchor pin 28, toward the player's position, if not hooked or sliced. As ball 10 then comes to rest after its return travel, the player need only pull the ball in by means of cord 16 and with minimum effort have ball 10 returned for the successive practice shot. Thus the player is spared the necessity of having to chase about the practice area to retrieve ball 10 for the following shot. Manifestly elastic segment 30 conduces to this return. Alternatively, a second player may be positioned a substantially equal distance from anchor pin 25, approximately opposite the first golfer in order that the two golfers may return shots to each other. For example, the tether cord could be preselectably unreeled twenty yards and the two golfers would stand about forty yards apart on approximately opposite sides of the anchor pin.

It will thus be seen that the cord 16, being non-elastic throughout its length, permits the ball to follow a more normally expected flight path. The elastic segment 30 merely comes into operation as the ball reaches its point of maximum travel. With prior art constructions it is to be noted that the tethering cord is jointly comprised of both elastic and non-elastic segments so that clearly the flight of the ball is greatly restrained throughout its travel by the elastic component as opposed to the present construction wherein the elastic segment merely serves by coming into operative state at the time the ball is reaching its point of maximum flight.

It will thus be seen that the practice with device A may continue as long as the player desires. At such time as the player elects to terminate all practicing he merely would release elastic segment 30 from cord 16 by disengaging knots 34 from slip knot 36. With cord 16 returned to a fully wound state within casing 22 wherein ball 10 would be butting against the post-carrying end of casing 22, device A is of maximum compact state for easy transportability as well as ease of storage such as in the standard glove compartment of a vehicle, or perhaps even within the player's golf bag so it would be readily available for use at a remote time juncture.

As the foregoing further reveals, device A is formed of a limited number of components all of which are manifestly durable so that said device A will have longevity of usage.

Figure 1:
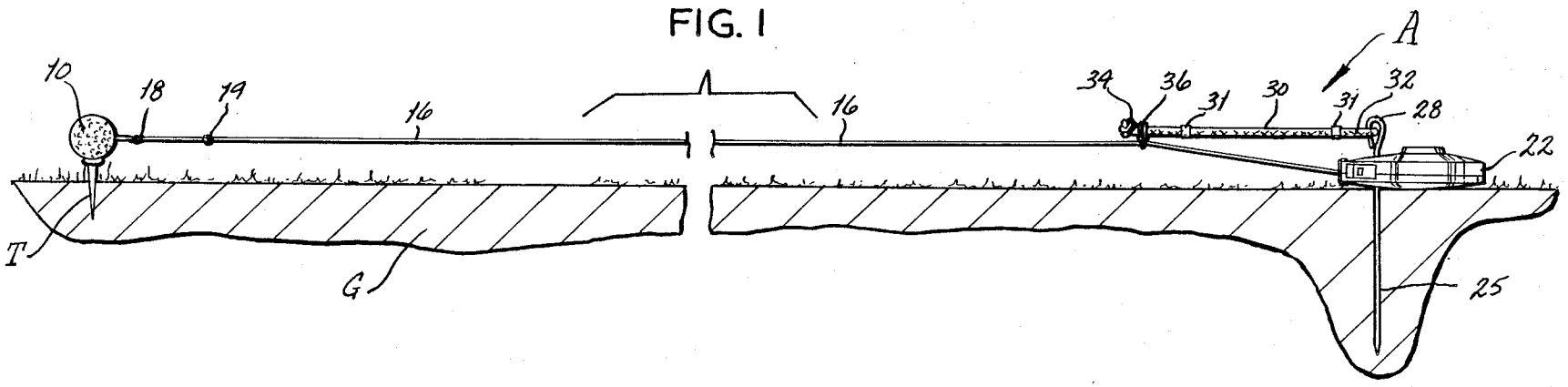
FIG. 1 is a side elevational view of a golf practice device constructed in accordance with, and embodying, the present invention; illustrating the device in position for ball-stroking.
Figure 2:
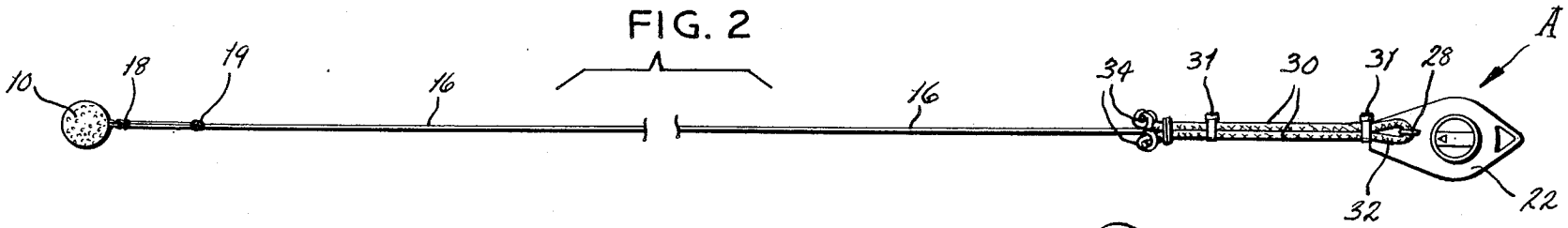
FIG. 2 is a top plan view of the device.
Figure 4:
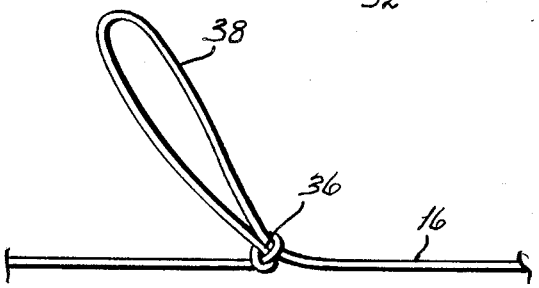
FIG. 4 illustrates, in perspective, the succeeding step in the formation of the knot illustrated in FIG. 3.
Figure 8:
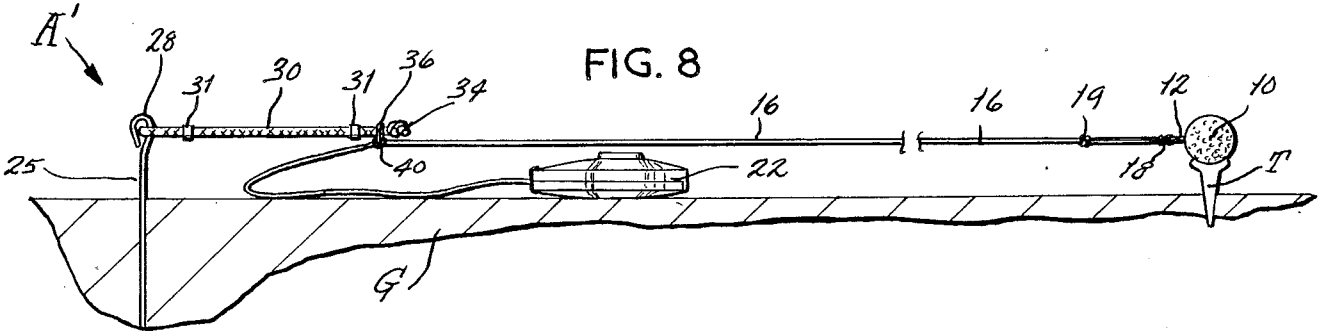
FIG. 8 is a side elevational view of another arrangement of the golf practice device constructed in accordance with, and embodying the present invention.

Referring now to FIG. 8, another form of the invention indicated A' is shown which embodies the present invention. In this form of the invention, the components are the same as shown in connection with device A hereinabove, so that like elements will bear like reference numerals. However the primary distinction between the structure shown in FIG. 8 and FIG. 1 is the fact that anchor pin 25 is located spacedly from, and independently of, spool casing 22. Elastic segment 30 is engaged to cord 16 at a point as at 40 which is relatively remote from casing 22. Thus the latter is disposed upon the ground, structurally independent of anchor pin 25.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all mattercontained in the foregoing description or shown in the accompanying drawings shall be interpreted as illustrative rather than limiting.

What is claimed is:

1. A device for the practice of golf strokes comprising a golf ball, a non-elastic elongated member of preselectable length having opposite ends, an elastic segment, reel means and anchor means; said non-elastic member comprising a tether cord and being securely attached at one end to said golf ball and at the other end to said reel means; said elastic segment being attached by one of its ends to a point along said tether cord and at its other end to said anchor means for prevention of transfer of shock to the reel means when said golf ball reaches the outermost point of its trajectory and for facilitating return of said ball; said tether cord having an integral component defined by its attachment at one end to said reel means and at its other end by the point of attachment of said elastic segment for checking the flight of the golf ball; the preselected length of said tether cord between said golf ball and said reel means defining the maximum length of the trajectory of the golf ball; said anchor means comprising a post-forming element for anchoring said device throughout use thereof.

2. The device of claim 1, wherein said reel means comprises a casing provided with an aperture for selective penetration therethrough by said anchor means; said reel further comprising a spool for attachment and winding therearound of said tether cord.

3. The device of claim 1, wherein said golf ball is provided with a folded-over double thickness of non-elastic elongated member material penetrating and sealed within said golf ball; said non-elastic member having a portion extending from said golf ball for removable attachment to one end of said tether cord.

4. The device of claim 1, said elastic segment and said post-forming element each being provided with cooperating, interlockable, loop-forming portions.

5. The device of claim 1, wherein said elastic segment is provided with opposite knotted ends brought into side-by-side relationship and said tether cord being provided with loop-forming means at a point relatively proximate said reel means; said knotted ends being engageable with said loop-forming means for firm interlocking of said tether cord and said elastic segment.

6. A device for the practice of golf strokes comprising a golf ball, a non-elastic elongated member of preselectable length having opposite ends, an elastic segment, reel means and anchor means; said non-elastic member comprising a tether cord being securely attached at one end to said golf ball and at the other end to said reel means; said reel means comprising a casing provided with an aperture for penetration therethrough by said anchor means for securing said reel means to the ground; said reel means further comprising spool means for attachment and winding therearound of said tether cord, for selective retention and storage therein; a loop-forming portion provided along said elastic segment and a loop-forming portion provided on said anchoring means for interlocking engagement thereof; said elastic segment provided with opposite knotted ends brought into side-by-side relationship and said tethering cord provided with loop-forming means at a point relatively proximate said reel means; said knotted ends being engageable with said loop-forming means for firm interlocking of said tether cord and said elastic segment; said elastic segment being attached to said tether cord for preventing transfer of shock to the reel means when said golf ball, after striking, reaches the outermost point of its trajectory and for facilitating return of said golf ball; said tether cord further comprising an integral component defined by its attachment at one end to said reel means and at its other end by the point of attachment of said elastic segment for checking the flight of the golf ball; the preselected length of said tether cord between said golf ball and said reel means defining the maximum length of trajectory of the golf ball; said anchor means comprising a post-forming element for anchoring said device throughout use thereof.

* * * * *